US012065718B2

(12) United States Patent
Miyoshi et al.

(10) Patent No.: US 12,065,718 B2
(45) **Date of Patent: *Aug. 20, 2024**

(54) BAR

(71) Applicant: NIPPON STEEL CORPORATION, Tokyo (JP)

(72) Inventors: Ryotaro Miyoshi, Tokyo (JP); Tomonori Kunieda, Tokyo (JP); Kazuhiro Takahashi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 112 days.

This patent is subject to a terminal disclaimer.

(21) Appl. No.: 17/432,129

(22) PCT Filed: Mar. 6, 2020

(86) PCT No.: PCT/JP2020/009700
§ 371 (c)(1),
(2) Date: Aug. 19, 2021

(87) PCT Pub. No.: WO2020/179912
PCT Pub. Date: Sep. 10, 2020

(65) Prior Publication Data

US 2022/0136087 A1 May 5, 2022

(30) Foreign Application Priority Data

Mar. 6, 2019 (JP) ..... 2019-040333

(51) Int. Cl.
*C22C 14/00* (2006.01)
*C22F 1/18* (2006.01)

(52) U.S. Cl.
CPC ..... *C22C 14/00* (2013.01); *C22F 1/183* (2013.01)

(58) Field of Classification Search
CPC ..... C22C 14/00; C22F 1/18; C22F 1/183
(Continued)

(56) References Cited

U.S. PATENT DOCUMENTS 9,689,062 B2 * 6/2017 Mori ..... C22F 1/002
2015/0191812 A1 * 7/2015 Mori ..... C22F 1/002 148/670
2021/0348252 A1 * 11/2021 Miyoshi ..... C22F 1/18

FOREIGN PATENT DOCUMENTS

EP 2 851 446 A1 3/2015
JP H07-70676 A 3/1995
(Continued)

OTHER PUBLICATIONS

NPL: on-line translation of JP 2005089834 A, Apr. 2005 (Year: 2005).*
(Continued)

*Primary Examiner* — Jie Yang
(74) *Attorney, Agent, or Firm* — Myers Wolin, LLC

(57) ABSTRACT

A bar includes a titanium alloy containing an α phase and a β phase, in which the titanium alloy contains, as a chemical composition, by mass %: Al: 4.5% to 6.4%; Fe: 0.5% to 2.1%; C: 0.01% or less; N: 0.05% or less; O: 0.25% or less; V: 0.10% or less; Si: 0% to 0.40%; Ni: 0% to 0.15%; Cr: 0% to 0.25%; Mn: 0% to 0.25%; and a remainder including Ti and impurities, an area ratio of the β phase in a metallographic structure of the titanium alloy is 20% or less, and an average minor axis length of grains of the β phase is 2.0 μm or less.

2 Claims, 2 Drawing Sheets

(58) Field of Classification Search
USPC ..... 420/420
See application file for complete search history.

(56) References Cited

FOREIGN PATENT DOCUMENTS

| | | | | |
|---|---|---|---|---|
| JP | 2005-89834 | A | | 4/2005 |
| JP | 2005089834 | A | * | 4/2005 |

OTHER PUBLICATIONS

NPL-1: Abdalla et al (NPL: Microstructures and Hardness of Newly Designed Ti—6Al—(1-3)Fe alloys, Applied Mechanics and Materials, vol. 864, pp. 142-146, 2017 (Year: 2017).*
Koike J. et al., "Stress-Induced Phase Transformation During Superplastic Deformation In Two-Phase Ti—Al—Fe Alloy", Acta mater., 2000, pp. 2059-2069, vol. 48, No. 9., Elsevier Science Ltd.
Koike J. et al., "Characterization of Superplasticity in Ti-5.5Al—1Fe Alloys", Scripta Materialia, 1998, pp. 1009-1014, vol. 39, No. 8, Elsevier Science Ltd.

* cited by examiner

BAR

CROSS-REFERENCE TO RELATED APPLICATION

This application is a National Phase of PCT/JP2020/009700, filed on Mar. 6, 2020, and which designated the U.S., which claims priority to Japanese Patent Application No. 2019-040333, filed on Mar. 6, 2019. The contents of each are wholly incorporated herein by reference.

TECHNICAL FIELD OF THE INVENTION

The present disclosure relates to a bar. In particular, the present disclosure relates to a bar consisting of a titanium alloy containing an α phase and a β phase.

Priority is claimed on Japanese Patent Application No. 2019-040333, filed Mar. 6, 2019, the content of which is incorporated herein by reference.

RELATED ART

Titanium alloys are excellent in strength, light weight, corrosion resistance, and the like and thus have been used in various fields in recent years.

Among the titanium alloys, a Ti-5Al-1Fe-based titanium alloy (hereinafter, simply referred to as "Ti-5Al-1Fe-based alloys") containing 5% of Al and 1% of Fe is excellent in the balance between strength and ductility. In addition, the Ti-5Al-1Fe-based alloy contains relatively inexpensive additive elements and thus is economical and has a wide range of application. For example, as the Ti-5Al-1Fe-based alloy, Patent Document 1 discloses an alloy containing, by mass %, 0.5% or more and less than 1.4% of Fe and 4.6% or more and less than 5.5% of Al.

RELATED ART DOCUMENT

Patent Document

[Patent Document 1] Japanese Unexamined Patent Application, First Publication No. H7-70676

SUMMARY

Problems to be Solved

There are cases where a titanium alloys are used for components of aircrafts and transporters such as vehicles, and in order to manufacture such components, for example, machining is required. Therefore, the material used for the above components is required to be easy to machine, that is, to have good machinability. However, the Ti-5Al-1Fe-based alloy has a problem that it is difficult to be machined because cutting scraps called chips growth thickly at the time of cutting. In particular, there is a demand for improved machinability in a bar made of a titanium alloy manufactured by a manufacturing method including forging.

An object of the present disclosure is to solve the above problems and to provide a bar consisting a free-cutting titanium alloy.

The present disclosure has been made to solve the above problems, and the gist thereof is as follows.

(1) According to an aspect of the present disclosure, a bar is consisting a titanium alloy containing an α phase and a β phase, in which the titanium alloy contains, as a chemical composition, by mass %: Al: 4.5% to 6.4%; Fe: 0.5% to 2.1%; C: 0.01% or less; N: 0.05% or less; O: 0.25% or less; V: 0.10% or less; Si: 0% to 0.40%; Ni: 0% to 0.15%; Cr: 0% to 0.25%; Mn: 0% to 0.25%; and a remainder: Ti and impurities, an area ratio of the β phase in a metallographic structure of the titanium alloy is 20% or less, and an average minor axis length of grains of the β phase is 2.0 μm or less.

(2) In the wire rod according to (1), the chemical composition may contain, by mass %, one or more selected from the group consisting of: Si: 0.15% to 0.40%; Ni: 0.05% to 0.15%; Cr: 0.10% to 0.25%; and Mn: 0.10% to 0.25%.

(3) In the wire rod according to (1) or (2), a ratio of a β phase having a KAM value of 1° or more to the β phase may be 40% or mom by area ratio.

Effects

According to the above aspect of the present disclosure, it is possible to obtain a bar consisting a free-cutting titanium alloy having excellent machinability.

DETAILED DESCRIPTION

The present inventors conducted various examinations on the machinability of a Ti-5Al-1Fe-based alloy forming a bar (material). As a result, the following findings (1) to (3) were obtained.

(1) A Ti-5Al-1Fe-based alloy is an alloy called an α+β type titanium alloy, and has an α phase and a β phase as a metallographic structure. The Ti-5Al-1Fe-based alloy has these two phases, so that the balance between strength and ductility is good.

(2) On the other hand, the β phase has high ductility and strong adhesiveness, which lowers machinability. Specifically, due to the presence of the β phase, cutting scraps called chips which are highly ductile, grow thick during cutting, and are thus difficult to cut. As a result, chips are less likely to be discharged and clogging is likely to occur, which lowers machinability. Furthermore, chips may adhere to the material of the Ti-5Al-1Fe-based alloy to be cut, a cutting tool, and the chips. In these case, the chips are less likely to be discharged and clogging occurs, which lowers machinability.

Figure 1:
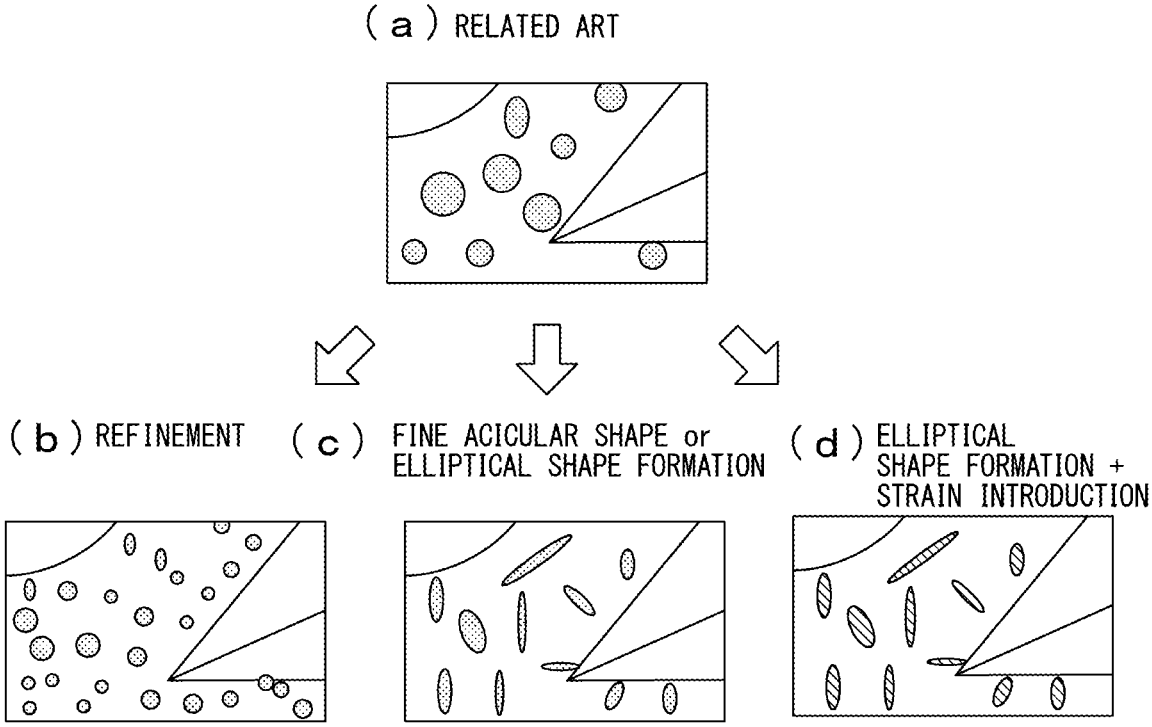
FIG. 1 is a diagram for describing an example of a method for controlling a β phase state for improving machinability.

(3) In order to improve the machinability, it is effective to appropriately control the area ratio of the β phase and to make the β phase fine and easy to cut. In order to make the β phase fine and easy to cut, as shown in FIG. 1, it is effective to reduce the size of the β phase and to introduce strain into the β phase to reduce the ductility of the β phase. Regarding the size of the β phase, not only in a case where the circle equivalent diameter thereof is reduced as shown in (b) of FIG. 1, but also in a case where the shape thereof is caused to be elliptical or acicular to reduce at least one length (minor axis length) as shown in (c) and (d), the machinability is improved.

The present disclosure has been made based on the above findings. Hereinafter, a preferred embodiment of the present disclosure will be described in detail, and at that time, the preferred embodiment of the present disclosure will be described as the present disclosure.

1. Phase

A bar according to the present embodiment is consisting a titanium alloy, and the titanium alloy contains an α phase and a β phase. The titanium alloy may consist of the α phase and the β phase.

2. Chemical Composition

The reasons for limiting each element are as follows. In the following description, "%" regarding the amount of an element means "mass %". In addition, a numerical range indicated with "to" includes the values at both ends. That is, 4.5% to 6.4% indicates 4.5% or more and 6.4% or less. However, values indicated by more than or less than do not include the value in the range.

Al: 4.5% to 6.4%

Al is an element having a high solid solution strengthening ability and an element that improves tensile strength at room temperature. In order to obtain a desired tensile strength (for example, 700 MPa or more), the Al content is set to 4.5% or more. The Al content is preferably set to 4.8% or more.

On the other hand, when the Al content exceeds 6.4%, deformation resistance increases and workability decreases. In addition, due to solidifying segregation or the like, the α phase, which is a primary phase, undergoes excessive solid solution strengthening, and hardness is locally increased. As a result, fatigue strength and impact toughness decrease. Therefore, the Al content is set to 6.4% or less. The Al content is preferably set to 5.4% or less.

Fe: 0.5% to 2.1%

Fe is a β-stabilizing element, has a high solid solution strengthening ability, and is an effective element for improving the tensile strength at room temperature. Furthermore, Fe has a Mo equivalent, which is an index for stabilizing the β phase, as high as 2.9 (in a case where Mo is 1, V is 0.67), and Fe diffuses fast. Therefore, in a case where Fe is contained, even when the temperature of the titanium alloy being machined rises to a high temperature due to deformation heating during cutting, the area ratio of the β phase is less likely to increase. As a result, chips are easily cut during cutting, and machinability is improved.

Figure 2:
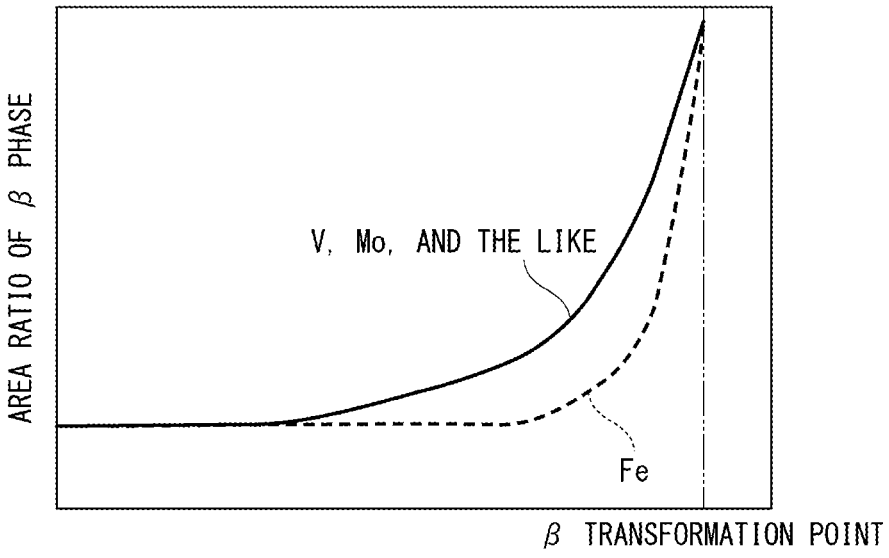
FIG. 2 is a schematic diagram showing a heating temperature (horizontal axis) and the area ratio of a β phase at that time in a titanium alloy containing Fe. V. or Mo.

FIG. 2 is a schematic diagram showing a heating temperature (horizontal axis) and the area ratio of a s phase at that time in a titanium alloy containing Fe or a titanium alloy containing V. Mo, or the like. As can be seen from FIG. 2, in a case where Fe is contained, the area ratio of the β phase is less likely to increase even if the temperature rises.

In order to obtain the above effect, the Fe content is set to 0.5% or more. The Fe content is preferably set to 0.8% or more. On the other hand, when the Fe content becomes excessive, the area ratio of the β phase becomes excessive, and on the contrary, the machinability is lowered, and segregation is likely to occur. Therefore, the Fe content is set to 2.1% or less. The Fe content is preferably set to 1.2% or less. When the Fe content is in the above range, the area ratio of the β phase becomes an appropriate amount, and the balance between the strength and ductility of the titanium alloy becomes good.

C: 0.01% or Less

N: 0.05% or Less

O: 0.25% or Less

C, N, and O are impurities, and may cause a decrease in ductility and workability when contained in a large amount. Therefore, the C content is set to 0.01% or less, the N content is set to 0.05% or less, and the O content is set to 0.25% or less.

On the other hand, there is a limit in industrial production to reduce the amounts of C, N, and O. In order to suppress an excessive increase in manufacturing cost, it is desirable that the amounts of these elements are set to C: 0.0001% or more, N: 0.0001% or more, and O: 0.01% or more.

O is also an element used for improving strength. In a case where O is used for improving strength, the O content may be set to 0.08% or more.

V: 0.10% or Less

V is an impurity, and when the V content is high, the area ratio of the β phase at a high temperature tends to increase. When the V content exceeds 0.10%, the increase in the area ratio of the β phase during cutting becomes significant, so that the V content is set to 0.10% or less.

Si: 0% to 0.40%

Si is a β-stabilizing element, but is also solid-solubilized in the α phase and has a high solid solution strengthening ability. Therefore, Si is an element that improves the strength of the titanium alloy that is the material of the bar. In addition, Si has a segregation tendency opposite to that of O (oxygen) described above and is less likely to undergo solidifying segregation as much as O (oxygen). Therefore, by including Si and O in combination, both tensile strength and fatigue strength can be improved. Therefore. Si and O may be contained as necessary. In addition, as described above, it is difficult to contain Fe in an amount of more than 2.1% due to the problem of segregation. Therefore, the strength can be improved by adjusting the Si content. Si may not be contained. However, in order to obtain the above effect, the Si content is preferably set to 0.15% or more.

On the other hand, when the Si content becomes excessive, the area ratio of the β phase becomes excessive and the machinability decreases. Therefore, the Si content is set to 0.40% or less. The Si content is preferably set to 0.35% or less.

Ni: 0% to 0.15%

Like Si, Ni is an element that has an effect of improving the strength of the titanium alloy. Therefore, Ni may be contained as necessary. In order to obtain the effect, the Ni content is preferably set to 0.05% or more.

On the other hand, when the Ni content becomes excessive, the area ratio of the β phase becomes excessive and the machinability decreases. In addition, an intermetallic compound ($Ti_2Ni$), which is an equilibrium phase, is formed, resulting in a decrease in fatigue strength and room temperature ductility. Therefore, the Ni content is set to 0.15% or less. The Ni content is preferably set to 0.10% or less.

Cr: 0% to 0.25%

Like Si, Cr has an effect of improving the strength of the titanium alloy. Therefore, Cr may be contained as necessary. In order to obtain the effect, the Cr content is preferably set to 0.10% or more.

On the other hand, when Cr is excessively contained, the area ratio of the β phase increases and the machinability decreases. In addition, an intermetallic compound ($TiCr_2$), which is an equilibrium phase, is formed, resulting in a decrease in fatigue strength and room temperature ductility. Therefore, the Cr content is set to 0.25% or less. The Cr content is preferably set to 0.20% or less.

Mn: 0% to 0.25%

Like Si, Mn has an effect of improving the strength of the titanium alloy. Therefore, Mn may be contained as necessary. In order to obtain the effect, the Mo content is preferably set to 0.10% or more.

On the other hand, when the Mn content becomes excessive, the area ratio of the β phase increases and the machinability decreases. In addition, an intermetallic compound (TiMn), which is an equilibrium phase, is formed, resulting in a decrease in fatigue strength and room temperature ductility. Therefore, the Mn content is set to 0.25% or less. The Mn content is preferably set to 0.20% or less.

In the chemical composition of the bar according to the present embodiment, the remainder is Ti and impurities. Here, the "impurities" are elements that are incorporated due to various factors including raw materials and the manufacturing process when the titanium alloy is industrially manufactured, and are acceptable in a range without adversely affecting the present disclosure. The total amount of the impurities is preferably 0.50% or less, excluding C, N, O, and V mentioned above. Examples of the impurities include H, Sn, Zr, Cu, Pd, W, B, Ta, and Hf in addition to C, N, O, and V mentioned above. In a case where H is contained as an impurity, the amount thereof is, for example, 0.015% or less. In a case where Sn, Zr, Cu, Pd, W, B, Ta, and Hf are contained, the amount thereof is, for example, each 0.05% or less.

3. Area Ratio of β Phase

In the α+β type titanium alloy, the β phase is necessary to ensure the balance between strength and ductility. However, the β phase has high adhesiveness. Therefore, when the amount of the β phase is excessive, ductility increases, and the ductility of chips themselves which are discharged, increases, so that the chips are less likely to be cut. In addition, adhesion occurs between the tool and the titanium alloy being machined, resulting in an increase in frictional resistance. Furthermore, adhesion occurs between the chips and the tool, and between the chips, so that clogging is likely to occur. As a result, machinability is lowered.

Therefore, in the titanium alloy forming the bar according to the present embodiment, the area ratio of the β phase is set to 20% or less with respect to the entire observed structure. The area ratio of the β phase is preferably set to 15% or less. On the other hand, although a reduction in the amount of the β phase is effective for improving the machinability, in order to improve the strength and ductility, the area ratio of the β phase is preferably set to 1% or more.

The area ratio of the β phase is measured by using an electron backscatter diffraction method (hereinafter, simply referred to as "EBSD") after an observed section is mirror-polished by electrolytic polishing or colloidal silica polishing. Specifically, the measurement is performed on the mirror-polished observed section at five visual fields with a region of 80 (μm)×140 (μm) as one visual field, under the condition that the acceleration voltage is 15 kV, the irradiation current amount is 10 nA, and the step is 0.3 μm, and the area ratio of the β phase is calculated based on the difference in crystal structure using an attached image analysis software "OLM-Analysis (registered trademark)".

The titanium alloy forming the bar according to the present embodiment needs to satisfy the above-described regulation of the area ratio of β phase in all the portions. When the area ratio of the β phase described above is 20% or less in all the portions, good machinability can be obtained. Here, for example, the area ratio of the β phase is also associated with the ease of cooling, so that the area ratio of the β phase is high in the vicinity of the surface where cooling is easy to proceed, and is low in the internal structure where cooling is difficult to proceed. Therefore, it is considered that when the regulation of the area ratio of the β phase is satisfied in the vicinity of the surface, that is, in the structure of the surface layer, the regulation of the β phase is also satisfied in the internal structure.

Therefore, when calculating the area ratio of the β phase, a test piece may be collected by cutting out the test piece from the vicinity of the surface (the vicinity of a worked surface) in a C-section of the bar made of the titanium alloy. Subsequently, for an observed section of the collected test piece, for example, the above-mentioned 80 (μm)×140 (μm) region may be set from the surface (worked surface). Accordingly, the area ratio of the β phase of the surface layer can be calculated, and it is possible to indirectly determine whether or not the area ratio of the β phase is 20% or less in the entire titanium alloy.

4. Average Minor Axis Length of β Phase

The β phase is α phase that is easily deformed and has high adhesiveness. Therefore, when the average minor axis length of the grains of the β phase (sometimes simply referred to as the average minor axis length of the β phase) exceeds 2.0 μm, the ductility of chips increases. Furthermore, the contact area with the tool increases, so that the frictional resistance with the tool increases and the chips become thick. Chips that have high ductility and are thick are less likely to be cut during cutting and are more likely to cause clogging. As a result, machinability is lowered. Therefore, in the bar according to the present embodiment, the average minor axis length of the β phase contained in the titanium alloy is set to 2.0 μm or less. The average minor axis length of the β phase is preferably set to 1.7 μm or less. The lower limit of the average minor axis length of the β phase is not particularly specified, but for example, it is considered that the lower limit thereof is 0.3 μm or more in a method described later.

In the bar according to the present embodiment, the machinability is improved by reducing the average minor axis length of the β phase through working of the titanium alloy or by reducing the ductility of the phase through a further introduction of strain into the β phase. The β phase has higher ductility and is more easily worked compared to the α phase. Therefore, as described above, when the titanium alloy is worked, the β phase is preferentially deformed to form an elongated elliptical shape, which is easily cut. That is, the machinability of the titanium alloy is improved.

The average minor axis length of the β phase is measured using EBSD after the observed section is mirror-polished by electrolytic polishing or colloidal silica polishing. Similar to the measurement of the area ratio of the β phase, the measurement is performed on the mirror-polished observed section at five visual fields with a region of 80 (μm)×140 (μm) as one visual field, under the condition that the acceleration voltage is 15 kV, the irradiation current amount is 10 nA, and the step is 0.3 μm. Then, the average minor axis length is calculated using "OIM-Analysis (registered trademark)", which is the image analysis software manufactured by TSL Solutions.

Here, the average minor axis length is defined as follows. Specifically, while setting only the β phase as a measurement object based on the difference in crystal structure, a range surrounded by high-angle grain boundaries at a misorientation 15° or more is defined as a grain, the maximum length of the grain is defined as a major axis a, and in a case where the grain is approximated by an ellipse, the length of a minor axis b of the ellipse (hereinafter, simply abbreviated to "minor axis") calculated from Expression (1) is defined as a minor axis length. The length of the minor axis of the grain of each s phase is calculated, and the average value is defined as the average minor axis length. The length a of the major axis and the area S of the grain are measured by EBSD.

$$S=\pi\times a\times b \quad (1)$$

The bar according to the present embodiment needs to satisfy the above-described regulation of the average minor axis length of the β phase in all the portions. When the average minor axis length of the β phase described above is 2.0 μm or less in all the portions, good machinability can be obtained. Strain is more likely to be introduced as close to the surface, and is less likely to be introduced as close to the inner structure. Therefore, the average minor axis length tends to be smaller in the vicinity of the surface than inside. Therefore, it is considered that when the regulation of the average minor axis length of the β phase is satisfied in the internal structure, that is, the structure in the vicinity of the center, the regulation of the average minor axis length is satisfied over an entire of the titanium alloy.

Therefore, when calculating the average minor axis length of the β phase, it is preferable to collect the test piece from the vicinity of the center in the C-section of the titanium alloy. Then, for the observed section of the collected test piece, for example, a region of 80 (μm)×140 (μm) from the center of the C-section may be set. That is, in the case of a bar, the above-mentioned region may be set from the center structure such as the center of the diameter, which is the most difficult to work.

5. Area Ratio of β Phase Having KAM Value of 1° or More

By introducing strain into the β phase, the ductility of the β phase decreases. Therefore, the chips are easily cut and the machinability is further improved. Therefore, in the bar according to the present embodiment, it is preferable to increase the area ratio of a β phase having a KAM value of 1° or more. A kernel average misorientation (KAM) value indicates the orientation difference between adjacent measurement points in a grain, and can be said to be the degree of strain introduced.

Specifically, in the bar according to the present embodiment, the area ratio of the β phase having a KAM value of 1° or more to the entire β phase observed (measured) is preferably 40% or more. When the area ratio of the β phase having a KAM value of 1° or more to the observed entire β phase is less than 40%, strain cannot be effectively introduced into the β phase, which is insufficient for a further improvement in the machinability. Therefore, it is preferable that the area ratio of the β phase having a KAM value of 1° or more to the entire β phase is set to 40% or more. The area ratio of the β phase is set to more preferably 50% or more, and even more preferably 60% or more.

The area ratio of the β phase having a KAM value of 1° or more can be measured using EBSD on the same observed section as the above-mentioned average minor axis length under the same conditions.

α Phase

Figure 3A:
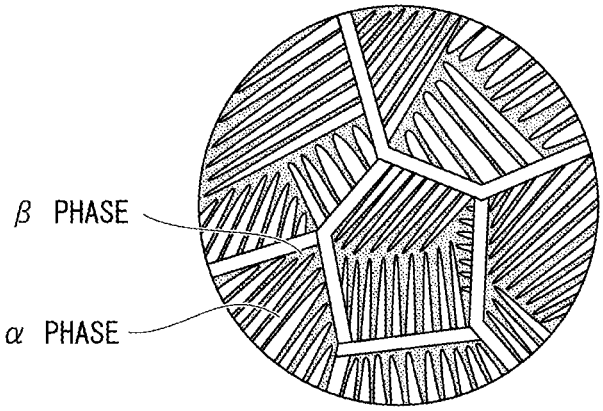
FIG. 3A is an example for describing an example of the structure of an α phase, and is a schematic diagram showing an example of the structure in a case where the α phase has an acicular structure.
Figure 3B:
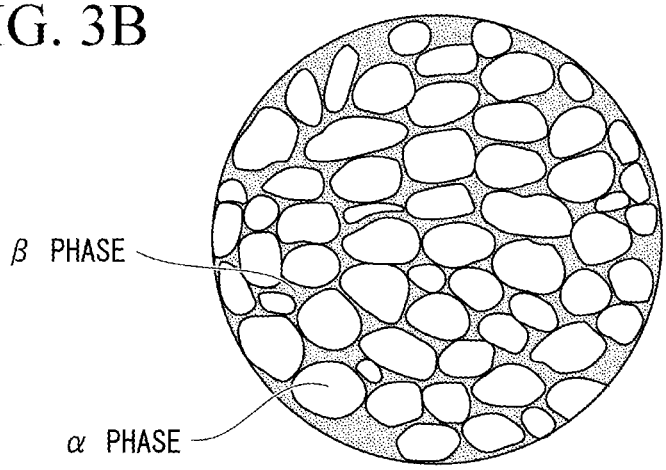
FIG. 3B is an example for describing an example of the structure of the α phase, and is a schematic diagram showing an example of the structure in a case where the α phase has an equiaxed structure.

In the bar according to the present embodiment, the α phase contained in the titanium alloy is not limited, and may be, for example, an acicular structure as shown in FIG. 3A or an equiaxed structure as shown in FIG. 3B. From the viewpoint of fatigue properties, the α phase is preferably an equiaxed structure having a small aspect ratio (for example, 3 or less), and from the viewpoint of crack propagation resistance, the α phase is preferably an acicular structure.

6. Target Characteristic Value

In the bar according to the present embodiment, VL1000 (rpm) obtained by a drill cutting test is used as an index for evaluating machinability. Here, VL1000 is the cutting speed of a drill capable of drilling a ole into a cumulative hole depth of 1000 mm, and the larger the numerical value, the better the machinability.

In the present embodiment, a case of a VL1000 of 9000 rpm or more is determined to have good machinability. In addition, a case of a VL1000 of less than 9000 rpm is determined to have poor machinability.

In the drill cutting test for calculating the VL1000 (rpm), an internal refueling type WC/Co cemented carbide drill (TiAl/N coating) having a diameter of 5 mm is used. Furthermore, as for the conditions of the test, using a water-soluble cutting oil (Yushiroken EC50), the test is conducted under the condition that the drilling speed is 0.1 mm/rev, and the hole depth is 15 mm (three times the drill diameter), and the cutting speed at which the drill life becomes 1000 mm is calculated.

7. Shape of Bar

In the bar according to the present embodiment, the size and shape of the cross section are not limited. Examples of the shape of the cross section include a circle, an ellipse, a quadrangle, and an octagon. In addition, the machinability becomes an issue as the cross section increases. Therefore, as the cross section increases, the effect when the bar according to the present embodiment is used becomes more significant. Therefore, for example, the diameter (circle equivalent diameter when the cross section is not a circle) of the cross section of the bar may exceed 2.5 mm. The diameter of the cross section may be 1500 mm or less.

8. Manufacturing Method

The bar according to the present embodiment can obtain its effects as long as it has the above-mentioned configuration regardless of the manufacturing method. However, with a manufacturing method including, for example, at least any one of the following step (I) or step (II), it is possible to appropriately control the area ratio of the β phase, the amount of strain introduced into the β phase, the shape of the β phase, and the like, which is preferable.

(I) Pretreatment step+hot working step.

(II) Cold working step.

Hereinafter, preferable conditions in each step will be described.

(I) Pretreatment Step+Hot Working Step

In a method of manufacturing the bar according to the present embodiment, in a case where a cold working step is not performed, it is necessary to perform a pretreatment step and a hot working step.

The pretreatment step and the hot working step have different preferable conditions depending on whether the α phase is set to have an equiaxed structure or is set to have an acicular structure.

(i) In Case where α Phase is Set to have Equiaxed Structure

In a case where the α phase has an equiaxed structure, the pretreatment is preferably performed under the following conditions.

(i-1) Working with a reduction of area of 10% to 30% is performed in a temperature range in which the temperature of the surface is 850° C. to 950° C.

(i-2) Heating is performed so that the temperature of the center becomes 1050° C. to 1200° C., and holding is performed in the temperature range for 5 to 15 minutes.

(i-3) Cooling to 770° C. or lower as the temperature of the center is performed at the average cooling rate of 10 to 100° C./sec.

In addition, the hot working is preferably performed under the following conditions.

(i-4) Hot forging with a reduction of area of 50% or more is performed in a temperature range in which the temperature of the surface is 850° C. to 950° C.

(i-5) Cooling to a temperature range of 700° C. to 770° C. as the temperature of the center is performed at the average cooling rate of 10° C./sec or faster.

(i-6) Holding is performed in a state in which the temperature of the center is 700° C. to 770° C. for 0.5 to 24 hours and cooling is performed, or cooling to 200° C. or lower as the temperature of the surface is performed at the average cooling rate of 1° C./sec or slower.

Hot working is, for example, forging or rolling.

Temperature control of the surface can be performed using values measured with a radiation-type thermometer or the like, and temperature control of the center can be performed by a simulation or application of conditions determined by the behavior of temperature changes using a thermocouple in advance.

(i-1) Working with a reduction of area of 10% to 30% is performed in a temperature range in which the temperature of the surface is 850° C. to 950° C.

(i-2) Heating is performed so that the temperature of the center becomes 1050° C. to 12(00° C., and holding is performed in the temperature range for 5 to 15 minutes.

In the pretreatment step, first, a bar-shaped material is subjected to hot working with a reduction of area of 10% to 30% in a temperature range in which the temperature of the surface is &50° C. to 950° C., thereafter heated so that the center temperature becomes 1050° C. to 1200° C. and held for 5 to 15 minutes. As the material, those having the above-mentioned chemical composition can be used, and those manufactured by a known method can be used. For example, an ingot produced from titanium sponge by various melting methods such as a vacuum are remelting method and a hearth melting method such as an electron beam melting method or a plasma melting method can be used. The retention time is the time after the temperature of the center of the material reaches 1050° C.

By performing working under the above conditions, strain for refinement of β grains after recrystallization can be introduced. Thereafter, through the holding, transformation into a β single phase occurs. The strain introduced by the working acts as a driving force, so that the β grains after the transformation become fine.

In a case where the β grains after the transformation have a coarse structure having an average circle equivalent diameter of more than 10 mm on average, it becomes difficult to finely disperse the β phases in a subsequent step. Therefore, the β grains after the transformation (after the pretreatment step) are caused to have a circle equivalent diameter of 10 mm or less on average.

When the working temperature exceeds 950° C. or the reduction of area is less than 10%, strain cannot be sufficiently introduced, the recrystallization of the β grains during the transformation is not promoted, and the circle equivalent diameter of the β grains after the transformation exceeds 10 mm. In this case, even if the subsequent hot forging is performed, the average minor axis length of the grains of the β phase cannot be 2.0 μm or less. On the other hand, when the working temperature is lower than 850° C. or the reduction of area exceeds 30%, forging cracks occur and it becomes difficult to perform working.

In addition, when the holding temperature exceeds 1200° C. or the retention time exceeds 15 minutes, the β grains after the transformation grow and the circle equivalent diameter thereof becomes more than 10 mm. Furthermore, when the holding temperature is lower than 1000° C. or the retention time is shorter than 5 minutes, the α phase remains and a heterogenous coarse α phase is formed, so that a uniform structure cannot be obtained. In this case, there is concern that the β phase formed around the α phase may also become coarse.

(i-3) Cooling to 770° C. or lower as the temperature of the center is performed at the average cooling rate of 10 to 100° C./sec.

After the holding, the material is subjected to water cooling to be cooled to 770° C. or lower at an average cooling rate of 10 to 100° C./sec to achieve refinement of the α phase to be precipitated. The cooling stop temperature is preferably lower than 700° C.

When the average cooling rate is slower than 10° C./sec or the cooling stop temperature exceeds 770° C. a coarse α phase is precipitated. In this case, as a result, the β phase precipitated between the α phases also becomes coarse.

On the other hand, when the average cooling rate exceeds 100° C./sec, martensite is generated and a target structure cannot be obtained.

(i-4) Hot forging with a reduction of area of 50% or more is performed in a temperature range in which the temperature of the surface is 850° C. to 950° C.

By performing heating in a temperature range of 850° C. to 950° C. and performing hot forging with a high reduction of area, acicular α generated during cooling is changed to equiaxed a having excellent workability and fatigue properties.

When the forging temperature is lower than 850° C., forging cracks occur and it becomes difficult to perform working. On the other hand, when the forging temperature exceeds 950° C., the area ratio of the α phase becomes too low, and the α phase cannot be finely dispersed after cooling. In this case, as a result, the α phase becomes coarse, and the β phase precipitated between the α phases also becomes coarse.

In addition, when the reduction of area is less than 50%, equiaxing does not proceed sufficiently.

In a case where cracks occur due to a decrease in the working temperature, reheating may be performed during the hot forging. However, in order to prevent the β phase from becoming coarse, reheating is performed for 5 hours or shorter per once, and the number of times of reheating is set to 7 or less. In a case where the reheating is performed, regarding the reduction of area, the total reduction of area before and after the reheating is controlled.

(i-5) Cooling to a temperature range of 700° C. to 770° C. as the temperature of the center is performed at the average cooling rate of 10° C./sec or faster (first cooling).

After the forging, the cooling rate in the temperature range up to 770° C., in which the α and β phases tend to be coarsened, is increased. When the average cooling rate is slower than 10° C./sec or the cooling stop temperature exceeds 770° C., the α phase and β phase become coarse. On the other hand, when the cooling stop temperature is lower than 700° C., the α phase is insufficiently generated, and the fraction of the β phase becomes too high in the final bar.

(i-6) Holding is performed in a state in which the temperature of the center is 700° C. to 770° C. for 0.5 to 24 hours and cooling is performed, or cooling to 200° C. or lower as the temperature of the surface is performed at the average cooling rate of 1° C./sec or slower.

After the first cooling, holding in a temperature range of 700° C. to 770° C. is performed or the cooling rate from this temperature range is lowered, whereby the β phase is transformed into the α phase, and the area ratio of the β phase becomes less than 20%.

When the holding is insufficiently performed and cooling is performed at an average cooling rate of faster than 1° C./sec, the area ratio of the β phase exceeds 20%.

In a case where holding at 700° C. to 770° C. is performed for 0.5 to 24 hours, subsequent cooling is not limited.

(ii) In Case where α Phase is Set to have Acicular Structure

In a case where the α phase has an acicular structure, the pretreatment and the hot working are preferably performed under the following conditions.

(ii-1) Hot working with a reduction of area of 10% to 30% is performed in a temperature range in which the temperature of the surface is 850° C. to 950° C.

(ii-2) Heating is performed so that the temperature of the center becomes 1050° C. to 1200° C., and holding is performed in the temperature range for 5 to 15 minutes.

(ii-3) Cooling to a temperature range of 700° C. to 770° C. as the temperature of the center is performed at the average cooling rate of 15° C./sec or faster.

(ii-4) Holding is performed in a state in which the temperature of the center is 700° C. to 770° C. for 0.5 to 24 hours and cooling is performed, or cooling to 200° C. or lower as the temperature of the surface is performed at the average cooling rate of 1° C./sec or slower.

In addition, hot working may be performed before the cooling of (ii-3). In a case where hot working is performed, the hot working is preferably performed under the following conditions.

(ii-2') Hot working is performed in a temperature range of 1000° C. or higher. The reduction of area and the like are not limited, and may be set to obtain a desired shape. However, since there is a concern about the coarsening of β grains, it is not preferable to perform reheating two or more times during the hot working.

(ii-1) Hot working with a reduction of area of 10% to 30% is performed in a temperature range in which the temperature of the surface is 850° C. to 950° C.

(ii-2) Heating is performed so that the temperature of the center becomes 1050° C. to 1200° C., and holding is performed in the temperature range for 5 to 15 minutes.

For the same reason as the case of forming the α phase having the equiaxed structure, the pretreatment step, first, a bar-shaped material is subjected to hot working with a reduction of area of 10% to 30% in a temperature range in which the temperature of the surface is 850° C. to 950° C., and thereafter held at 1050° C. to 1200° C. for 5 to 15 minutes.

(ii-2') Hot working is performed in a temperature range of 1000° C. or higher.

After the holding, hot working such as hot forging may be performed for the purpose of achieving a predetermined shape. However, when forging is performed at lower than 1000° C., equiaxing proceeds. Therefore, the forging temperature is preferably set to 1000° C. or higher. In a case where the temperature is low before the hot working, heating (reheating) may be performed. However, it is not preferable to perform reheating two or more times during the hot working because the β grains become coarse.

(ii-3) Cooling to a temperature range of 700° C. to 770° C. as the temperature of the center is performed at the average cooling rate of 15° C./sec or faster (first cooling).

The cooling rate in a temperature range up to 770° C. in which the α and β phases tend to be coarse is increased. When the average cooling rate is slower than 15° C./sec or the cooling stop temperature exceeds 770° C., the α phase and β phase become coarse.

On the other hand, when the cooling stop temperature is lower than 700° C., the α phase is insufficiently generated, and the fraction of the β phase becomes too high in the final bar.

The average cooling rate mentioned here means an average cooling rate after forging in a case where forging is performed or from the start of cooling in a case where forging is not performed, to the stop of the cooling.

(ii-4) Holding is performed in a state in which the temperature of the center is 700° C. to 770° C. for 0.5 to 24 hours and cooling is performed, or cooling to 200° C. or lower as the temperature of the surface is performed at the average cooling rate of 1° C./sec or slower.

After the first cooling, holding in a temperature range of 700° C. to 770° C. is performed for a predetermined time or the cooling rate from this temperature range is lowered, whereby the β phase is transformed into the α phase, and the area ratio of the β phase becomes less than 20%. When the holding is insufficiently performed and cooling is performed at an average cooling rate of faster than 1° C./sec, the area ratio of the β phase exceeds 20%.

On the other hand, when the retention time is long, the β phase becomes coarse.

In a case where holding at 700° C. to 770° C. is performed for 0.5 to 24 hours, subsequent cooling is not limited.

(II) Cold Working

In the cold working step, it is preferable to perform the cold working at a temperature of 200° C. or lower as the temperature of the center so that the reduction of area becomes 10% or more. In a case where the pretreatment and the hot working are not performed, the cold working step is indispensable. Even in the case where cold working is performed, hot working may be performed before the cold working for the purpose of obtaining a predetermined shape, but the hot working conditions in that case are not limited.

The above working suppresses recrystallization after the working. Furthermore, by preferentially deforming the β phase and introducing strain into the β phase, the β phase can be stretched or finely divided. As a result, the shape of the β phase can be formed into an elongated elliptical shape, and the average minor axis length of the β phase can be set to 2.0 μm or less. In addition, by the cold working, the area ratio of the β phase having a KAM value of 1° or more can be increased.

When the cold working temperature exceeds 200° C. or the reduction of area is less than 10%, a sufficient effect cannot be obtained.

There is no upper limit to the reduction of area. However, when the reduction of area exceeds 20%, cracks and internal defects are likely to occur during the working. Therefore, a substantial reduction of area is set to 20% or less.

At this time, it is desirable to uniformly introduce strain into the β phase. In this case, in a case where the length of the titanium alloy in a reduction direction before the working of the titanium alloy is indicated as A, it is preferable that reduction is performed with a reduction of 0.05 A (mm) or more for each reduction while the contact area with a die is 0.1 $A^2$ ($mm^2$) or more. In addition, it is preferable to perform reduction on the outer circumference in order in at least two orthogonal directions.

In the case of a multi-axial forging machine, it is preferable to pressurize the surface orthogonal to the reduction direction and apply the reduction in a state where expansion in a width direction due to the reduction is suppressed. By this working, the β phase can be uniformly worked, and the area ratio of the β phase having a KAM value of 1° or more can be set to 40% or more.

Hereinafter, the present disclosure will be described more specifically with reference to examples, but the present disclosure is not limited thereto.

EXAMPLES

Titanium ingots having the chemical compositions of Kind Nos. A to S shown in Table 1 were manufactured and subjected to a pretreatment, hot working, and cold working as shown in Tables 2-1 to 2-6 to obtain bars having a rectangular shape with a cross section of 200×300 mm. However, "-" in the tables indicates that the corresponding step was not performed.

In the examples in which the cold working was performed, in a case where the length of a titanium alloy in a reduction direction before working the titanium alloy is indicated as A in the cold working, reduction was performed with a reduction of 0.05 A (mm) or more for each reduction while the contact area with a die was 0.1 $A^2$ ($mm^2$) or more. In addition, reduction was performed on the outer circumference in order in at least two orthogonal directions.

In the tables, the reduction of area at 850° C. to 950° C. and the cooling rate up to 200° C. or lower were controlled based on the temperature of the surface, and controlled based on the temperature of the center in the other cases.

(Grain Size of Prior β Grains after Pretreatment Step)

In a case where the pretreatment was performed, the grain size of prior β grains after the pretreatment step was measured by the following method. A measurement portion was in the vicinity of the center of a cross section perpendicular to the longitudinal direction, and the grains were measured by an intercept method. The observation magnification was set to any magnification at which ten or more prior β grains could be cut with one line segment, and the number of line segments was set to any number such that the total number of cut prior β grains was 100 or more.

(Microstructure after Hot Working)

Regarding the microstructure of the bar after the hot working, the morphology of the α phase was observed and the average minor axis length of the β phase was obtained.

Regarding the α phase, the α phase was determined to have an acicular structure in the case of the structure shown in FIG. 3A and determined to have an equiaxed structure in the case of the structure shown in FIG. 3B.

The average minor axis length of the β phase was measured by the following method.

The section to be observed was mirror-polished by electrolytic polishing or colloidal silica polishing, and as in the measurement of the area ratio of the β phase, the measurement was performed on the mirror-polished observed section at five visual fields with a region of 80 (μm)×140 (μm) at a step of 0.3 μm at an acceleration voltage of 15 kV and an irradiation current amount of 10 nA. Then, the average minor axis length was calculated using "OIM-Analysis (registered trademark)", which is an image analysis software manufactured by TSL Solutions.

When measuring the average minor axis length of the β phase, a test piece was collected from the vicinity of the center in a C-section of the titanium alloy, and regarding the observed section, a sample was produced so that a region of 80 (μm)×140 (μm) in the vicinity of the center position in the C-section of the titanium alloy was the observed section.

In addition, the microstructure of the bar after the cold working (after the hot working in a case where the cold working was not performed) was observed, and the area ratio of the β phase, the average minor axis length of the β phase, and the area ratio of above β phase having a KAM value of 1° or more were obtained.

(Area Ratio of β Phase)

The area ratio of the β phase was measured by using an electron backscatter diffraction method (hereinafter, simply referred to as "EBSD") after the observed section was mirror-polished by electrolytic polishing or colloidal silica polishing in the above-described method. Specifically, the measurement was performed on the mirror-polished observed section at five visual fields with a region of 80 (μm)×140 (μm) at a step of 0.3 μm at an acceleration voltage of 15 kV and an irradiation current amount of 10 nA, the area ratio of the β phase was calculated using "OIM-Analysis (registered trademark)", which is an image analysis software manufactured by TSL Solutions.

When calculating the area ratio of the β phase, a test piece was cut out from the vicinity of a worked surface in the C-section of the bar, and a sample was produced so that a region of 80 (μm)×140 (μm), which was 140 (μm) in the width direction at a position of 80 (μm) in the thickness direction from the worked surface, was the observed section.

(Average Minor Axis Length of β Phase and Area Ratio of β Phase Having KAM Value of 1° or More)

Similarly, the average minor axis length of the β phase and the area ratio of the β phase having a KAM value of 1° or more were also measured using EBSD. The section to be observed was mirror-polished by electrolytic polishing or colloidal silica polishing, and as in the measurement of the area ratio of the β phase, the measurement was performed on the mirror-polished observed section at five visual fields with a region of 80 (μm)×140 (μm) at a step of 0.3 μm at an acceleration voltage of 15 kV and an irradiation current amount of 10 nA. Then, the average minor axis length was calculated using "OIM-Analysis (registered trademark)", which is an image analysis software manufactured by TSL Solutions.

When measuring the average minor axis length of the β phase and the area ratio of the β phase having KAM value of 1° or more, a test piece was collected from the vicinity of the center in a C-section of the titanium alloy, and regarding the observed section, a sample was produced so that a region of 80 (μm)×140 (μm) in the vicinity of the center position in the C-section of the titanium alloy was the observed section.

(Drill Cutting Test)

For the obtained bar made of the titanium alloy, a sample of 40 (mm) in width×40 (mm) in thickness×50 (mm) in length was produced, a drill cutting test was performed, a VL1000 was calculated, and a case of a VL1000 of 9000 rpm or more was determined to have good machinability. In addition, a case of a V1000 of less than 9000 rpm was determined to have poor machinability.

The results are shown in Tables 2-1 to 2-6.

In the drill cutting test, an internal refueling type WC/Co cemented carbide drill (TiAl/N coating) having a diameter of 5 mm was used. Furthermore, as for the conditions of the test, using a water-soluble cutting oil (Yushiroken EC50), the test was conducted under the condition that the drilling speed was 0.1 mm/rev, and the hole depth was 15 mm (three times the drill diameter), and the cutting speed at which the drill life became 1000 mm was calculated.

(Hardness Test)

As a reference, the obtained titanium alloy was subjected to a hardness test, which is an index of strength. In the hardness test, a Vickers hardness tester was used, and the test was conducted with a load of 500 gf according to JIS Z 2244:2009.

The results are shown in Tables 2-1 to 2-6.

Hereinafter, Table 1 and Tables 2-1 to 2-6 are collectively shown.

TABLE 1

| Kind | Chemical composition (mass %, remainder: Ti and impurities) | | | | | | | | | | |
|---|---|---|---|---|---|---|---|---|---|---|---|
| No. | Al | Fe | C | N | O | Si | Ni | Cr | Mn | V | Note |
| A | 5.1 | 1.0 | — | — | 0.18 | — | — | — | — | — | |
| B | 4.5 | 1.0 | — | — | 0.18 | — | — | — | — | — | |
| C | 6.4 | 1.0 | — | 0.01 | 0.17 | — | — | — | — | — | |
| D | 5.1 | 0.5 | — | — | 0.19 | — | — | — | — | — | |
| E | 5.1 | 2.1 | — | — | 0.08 | — | — | — | — | — | |
| F | 5.1 | 1.0 | — | — | 0.18 | 0.40 | — | — | — | — | |
| G | 5.1 | 1.0 | | 0.01 | 0.25 | — | — | — | — | — | |
| H | 5.1 | 1.0 | — | — | 0.18 | — | 0.15 | — | — | — | |
| I | 5.1 | 1.0 | — | — | 0.18 | — | — | 0.25 | — | — | |
| J | 5.1 | 1.0 | — | — | 0.18 | — | — | — | 0.25 | — | |
| K | 5.1 | 1.0 | — | — | 0.18 | — | 0.15 | — | — | — | |
| L | 5.1 | 1.0 | 0.01 | — | 0.18 | — | — | — | — | — | |
| M | 6.2 | 0.2* | — | — | 0.18 | — | — | | — | 4.1* | Material of related art (Ti—6Al—V4) |
| N | 5.1 | 1.0 | — | 0.01 | 0.18 | — | — | — | — | — | |
| O | 5.1 | 3.5* | — | 0.01 | 0.18 | — | — | — | — | — | |
| P | 5.1 | 1.0 | — | — | 0.18 | 0.70* | — | — | — | — | |
| Q | 5.1 | 1.0 | — | 0.01 | 0.18 | — | 0.50* | — | — | — | |
| R | 5.1 | 1.0 | — | — | 0.18 | — | — | 0.50* | — | — | |
| S | 5.1 | 1.0 | — | — | 0.18 | — | — | — | 0.50* | — | |

*means that the value is outside the range of the chemical composition specified in the present invention.

— shows that the corresponding element is not intentionally added.

TABLE 2-1

| | | Manufacturing conditions | | | | | |
|---|---|---|---|---|---|---|---|
| | | Pretreatment step | | | | | Grain size of |
| Test No. | Kind No. | Reduction of area at 850° C. to 950° C. (%) | Holding temperature (° C.) | Retention time (min) | Cooling rate (° C./sec) | Cooling stop temperature (° C.) | prior β grains after pretreatment (mm) |
| 1 | A | 10 | 1050 | 15 | 10 | 150 | 1 |
| 2 | A | 30 | 1200 | 5 | 100 | 770 | 9 |
| 3 | A | — | — | — | — | — | — |
| 4 | A | — | — | — | — | — | — |
| 5 | A | — | — | — | — | — | — |
| 6 | A | — | — | — | — | — | — |
| 7 | A | — | — | — | — | — | — |
| 8 | A | — | — | — | — | — | — |
| 9 | A | — | — | — | — | — | — |
| 10 | A | — | — | — | — | — | — |
| 11 | A | — | — | — | — | — | — |
| 12 | B | — | — | — | — | — | — |
| 13 | C | — | — | — | — | — | — |
| 14 | D | — | — | — | — | — | — |
| 15 | E | — | — | — | — | — | — |
| 16 | F | — | — | — | — | — | — |
| 17 | G | — | — | — | — | — | — |
| 18 | H | — | — | — | — | — | — |
| 19 | I | — | — | — | — | — | — |
| 20 | J | | | | | | |
| 21 | K | — | — | — | — | — | — |
| 22 | L | — | — | — | — | — | — |
| 23 | M | — | — | — | — | — | — |
| 24 | M | 10 | 1050 | 15 | 10 | 150 | 1 |
| 25 | A | 10 | 1050 | 15 | 10 | 150 | 2 |
| 26 | A | 10 | 1050 | 15 | 10 | 150 | 1 |
| 27 | A | 5 | 1050 | 15 | 10 | 150 | 13 |
| 28 | A | 10 | 1300 | 15 | 10 | 150 | 15 |
| 29 | A | 10 | 1200 | 30 | 10 | 150 | 11 |

TABLE 2-1-continued

| Test No. | Kind No. | Manufacturing conditions: Pretreatment step: Reduction of area at 850° C. to 950° C. (%) | Holding temperature (° C.) | Retention time (min) | Cooling rate (° C./sec) | Cooling stop temperature (° C.) | Grain size of prior β grains after pretreatment (mm) |
|---|---|---|---|---|---|---|---|
| 30 | A | 10 | 1050 | 15 | 5 | 150 | 12 |
| 31 | A | 10 | 1050 | 15 | 10 | 900 | 11 |
| 32 | A | — | — | — | — | — | — |
| 33 | A | — | — | — | — | — | — |
| 34 | A | — | — | — | — | — | — |
| 35 | A | — | — | — | — | — | — |
| 36 | A | — | — | — | — | — | — |
| 37 | O | — | — | — | — | — | — |
| 38 | P | — | — | — | — | — | — |
| 39 | Q | — | — | — | — | — | — |
| 40 | R | — | — | — | — | — | — |
| 41 | S | — | — | — | — | — | — |

* means outside the range of the present invention.
** means outside the preferable range of the present invention.
— means that the corresponding step is not performed.

TABLE 2-2

| Test No. | Kind No. | Manufacturing conditions: Hot working step: Heating temperature (° C.) | Forging finishing temperature (° C.) | Reduction of area at 850° C. to 950° C. (%) | Number of times of reheating | First average cooling rate (° C./sec) | First cooling stop temperature (° C.) | Retention time at 700° C. to 770° C. (h) | Cooling rate up to 200° C. or lower (° C./sec) | Cold working step: Temperature (° C.) | Reduction of area (%) |
|---|---|---|---|---|---|---|---|---|---|---|---|
| 1 | A | 930 | 890 | 51 | 1 | 10 | 730 | — | 1 | — | — |
| 2 | A | 930 | 890 | 51 | 1 | 10 | 730 | 24.0 | 15 | — | — |
| 3 | A | 730 | 680 | 36 | 0 | — | — | — | 50 | 100 | 10 |
| 4 | A | 730 | 680 | 36 | 0 | — | — | — | 1 | 100 | 10 |
| 5 | A | 930 | 875 | 51 | 1 | — | — | — | 50 | 100 | 10 |
| 6 | A | 930 | 880 | 51 | 7 | — | — | — | 1 | 100 | 10 |
| 7 | A | 950 | 890 | 51 | 2 | — | — | — | 1 | 100 | 20 |
| 8 | A | 930 | 875 | 51 | 1 | — | — | — | 1 | 25 | 10 |
| 9 | A | 930 | 875 | 36 | 0 | — | — | — | 1 | 25 | 20 |
| 10 | A | 930 | 875 | 91 | 7 | — | — | — | 1 | 200 | 10 |
| 11 | A | — | — | — | — | — | — | — | 1 | 200 | 20 |
| 12 | B | 930 | 868 | 51 | 1 | — | — | — | 1 | 100 | 10 |
| 13 | C | 930 | 877 | 51 | 1 | — | — | — | 1 | 100 | 10 |
| 14 | D | 930 | 865 | 51 | 1 | — | — | — | 1 | 100 | 10 |
| 15 | E | 930 | 858 | 51 | 1 | — | — | — | 1 | 100 | 10 |
| 16 | F | 930 | 864 | 51 | 1 | — | — | — | 1 | 100 | 10 |
| 17 | G | 930 | 882 | 51 | 1 | — | — | — | 1 | 100 | 10 |
| 18 | H | 930 | 862 | 51 | 1 | — | — | — | 1 | 100 | 10 |
| 19 | I | 930 | 881 | 51 | 1 | — | — | — | 1 | 100 | 10 |
| 20 | J | 930 | 875 | 51 | 1 | — | — | — | 1 | 100 | 10 |
| 21 | K | 930 | 872 | 51 | 1 | — | — | — | 1 | 100 | 10 |
| 22 | L | 930 | 879 | 51 | 1 | — | — | — | 1 | 100 | 10 |
| 23 | M | 930 | 892 | 51 | 0 | 55 | 730 | — | 1 | 100 | 10 |
| 24 | M | 930 | 887 | 51 | 0 | 55 | 730 | — | 1 | — | — |
| 25 | A | 930 | 895 | 51 | 8 | 15 | 730 | — | 1 | — | — |
| 26 | A | 930 | 882 | 51 | 0 | 15 | 730 | — | 15 | — | — |
| 27 | A | 930 | 884 | 51 | 1 | 15 | 730 | — | 1 | — | — |
| 28 | A | 930 | 884 | 51 | 1 | 15 | 730 | — | 1 | — | — |
| 29 | A | 930 | 884 | 51 | 1 | 15 | 730 | — | 1 | — | — |
| 30 | A | 930 | 884 | 51 | 1 | 15 | 730 | — | 1 | — | — |
| 31 | A | 930 | 884 | 51 | 1 | 15 | 730 | — | 1 | — | — |
| 32 | A | 930 | 875 | 51 | 1 | — | — | — | 1 | 930 | 20 |
| 33 | A | 930 | 875 | 51 | 1 | — | — | — | 1 | 250 | 20 |
| 34 | A | 930 | 875 | 51 | 1 | — | — | — | 1 | 25 | 5 |
| 35 | A | 930 | 875 | 51 | 1 | — | — | — | 1 | 100 | 5 |
| 36 | A | 930 | 875 | 51 | 1 | — | — | — | 1 | 200 | 5 |
| 37 | O | 930 | 871 | 51 | 1 | — | — | — | 1 | 100 | 10 |
| 38 | P | 930 | 877 | 51 | 1 | — | — | — | 1 | 100 | 10 |
| 39 | Q | 930 | 879 | 51 | 1 | — | — | — | 1 | 100 | 10 |

TABLE 2-2-continued

| | | Manufacturing conditions | | | | | | | | | |
|---|---|---|---|---|---|---|---|---|---|---|---|
| | | Hot working step | | | | | | | | Cold working step | |
| Test No. | Kind No. | Heating temperature (° C.) | Forging finishing temperature (° C.) | Reduction of area at 850° C. to 950° C. (%) | Number of times of reheating | First average cooling rate (° C./sec) | First cooling stop temperature (° C.) | Retention time at 700° C. to 770° C. (h) | Cooling rate up to 200° C. or lower (° C./sec) | Temperature (° C.) | Reduction of area (%) |
| 40 | R | 930 | 869 | 51 | 1 | — | — | — | 1 | 100 | 10 |
| 41 | S | 930 | 881 | 51 | 1 | — | — | — | 1 | 100 | 10 |

* means outside the range of the present invention.
** means outside the preferable range of the present invention.
— means that the corresponding step is not performed.

TABLE 2-3

| | | Microstructure after hot working | | Microstructure after cold working (after hot working in case where cold working is not performed) | | | Characteristic evaluation | | |
|---|---|---|---|---|---|---|---|---|---|
| Test No. | Kind No. | Structure morphology of α phase | Average minor axis length of β phase (μm) | Area ratio of β phase (%) | Average minor axis length of β phase (μm) | Area ratio of β phase having KAM value of 1° or more (%) | VL1000 (rpm) | Hardness ($HV_{0.5}$) | |
| 1 | A | Equiaxed | 2.0 | 6 | 2.0 | 2** | 9000 | 305 | Present |
| 2 | A | Equiaxed | 2.0 | 7 | 2.0 | 1** | 9000 | 305 | Invention |
| 3 | A | Equiaxed | 2.3 | 6 | 1.5 | 55 | 10500 | 300 | Example |
| 4 | A | Equiaxed | 2.5 | 5 | 1.4 | 53 | 11000 | 302 | |
| 5 | A | Equiaxed | 3.3 | 15 | 1.8 | 52 | 9500 | 298 | |
| 6 | A | Equiaxed | 3.0 | 7 | 1.5 | 58 | 10500 | 305 | |
| 7 | A | Equiaxed | 2.5 | 8 | 1.3 | 56 | 10500 | 289 | |
| 8 | A | Equiaxed | 2.7 | 7 | 1.4 | 62 | 10500 | 300 | |
| 9 | A | Equiaxed | 2.4 | 8 | 1.3 | 98 | 10500 | 300 | |
| 10 | A | Equiaxed | 2.6 | 8 | 1.8 | 40 | 9000 | 298 | |
| 11 | A | Equiaxed | 3.1 | 9 | 1.5 | 55 | 10000 | 299 | |
| 12 | B | Equiaxed | 2.6 | 8 | 1.5 | 48 | 10000 | 286 | |
| 13 | C | Equiaxed | 2.4 | 7 | 1.4 | 49 | 10500 | 362 | |
| 14 | D | Equiaxed | 2.1 | 2 | 0.5 | 52 | 11500 | 283 | |
| 15 | E | Equiaxed | 3.5 | 20 | 2.0 | 51 | 9000 | 310 | |
| 16 | F | Equiaxed | 2.3 | 7 | 1.6 | 50 | 10500 | 320 | |
| 17 | G | Equiaxed | 2.4 | 9 | 1.7 | 54 | 10000 | 340 | |
| 18 | H | Equiaxed | 2.5 | 8 | 1.7 | 53 | 10000 | 315 | |
| 19 | I | Equiaxed | 2.9 | 11 | 1.8 | 55 | 9500 | 320 | |
| 20 | J | Equiaxed | 3.2 | 13 | 1.8 | 55 | 9500 | 323 | |
| 21 | K | Equiaxed | 3.2 | 14 | 1.8 | 51 | 9500 | 323 | |
| 22 | L | Equiaxed | 3.1 | 12 | 1.7 | 52 | 9500 | 325 | |
| 23 | M | Equiaxed | 2.7 | 9 | 2.0 | 42 | 7000 | 320 | Comparative |
| 24 | M | Equiaxed | 3.0 | 9 | 3.0* | 1** | 6500 | 320 | Example |
| 25 | A | Equiaxed | 3.9 | 10 | 3.9* | 0** | 6500 | 295 | |
| 26 | A | Equiaxed | 3.5 | 21* | 3.5* | 2** | 6000 | 290 | |
| 27 | A | Equiaxed | 3.9 | 9 | 3.9* | 0** | 6000 | 290 | |
| 28 | A | Equiaxed | 4.2 | 9 | 4.2* | 0** | 6500 | 295 | |
| 29 | A | Equiaxed | 3.4 | 8 | 3.4* | 1** | 6000 | 290 | |
| 30 | A | Equiaxed | 3.8 | 10 | 3.8* | 0** | 6500 | 295 | |
| 31 | A | Equiaxed | 4.0 | 9 | 4.0* | 1** | 6000 | 295 | |
| 32 | A | Equiaxed | 2.5 | 9 | 2.5* | 5** | 8500 | 305 | |
| 33 | A | Equiaxed | 2.4 | 8 | 2.3* | 34** | 8500 | 295 | |
| 34 | A | Equiaxed | 2.5 | 8 | 2.2* | 15** | 8500 | 305 | |
| 35 | A | Equiaxed | 2.4 | 8 | 2.5* | 5** | 8000 | 298 | |
| 36 | A | Equiaxed | 2.6 | 8 | 2.7* | 10** | 8000 | 292 | |
| 37 | O | Equiaxed | 4.5 | 32* | 2.8* | 50 | 7000 | 375 | |
| 38 | P | Equiaxed | 4.2 | 30* | 2.9* | 51 | 7000 | 342 | |
| 39 | Q | Equiaxed | 4.1 | 35* | 2.7* | 52 | 7000 | 351 | |
| 40 | R | Equiaxed | 4.2 | 32* | 2.9* | 52 | 7000 | 345 | |
| 41 | S | Equiaxed | 4.2 | 34* | 2.8* | 56 | 7000 | 338 | |

*means outside the range of the present invention.
**means outside tht preferable range of the present invention.
— means dial the corresponding step is not performed.

TABLE 2-4

| Test No. | Kind No. | Manufacturing conditions Pretreatment step: Reduction of area at 850° C. to 950° C. (%) | Holding temperature (° C.) | Retention time (min) | Grain size of prior β grains after pretreatment (mm) |
|---|---|---|---|---|---|
| 42 | A | 10 | 1050 | 15 | 1 |
| 43 | A | 30 | 1200 | 5 | 10 |
| 44 | A | — | — | — | — |
| 45 | A | 5 | 1050 | 15 | 13 |
| 46 | A | 10 | 1300 | 15 | 15 |
| 47 | A | 10 | 1200 | 30 | 13 |
| 48 | A | 10 | 1050 | 15 | 1 |

TABLE 2-4-continued

| Test No. | Kind No. | Manufacturing conditions Pretreatment step: Reduction of area at 850° C. to 950° C. (%) | Holding temperature (° C.) | Retention time (min) | Grain size of prior β grains after pretreatment (mm) |
|---|---|---|---|---|---|
| 49 | A | 10 | 1050 | 15 | 1 |
| 50 | A | 10 | 100 | 15 | 1 |
| 51 | N | — | — | — | — |

* means outside the range of the present invention.
** means outside the preferable range of the present invention.
— means that the corresponding step is not performed.

TABLE 2-5

| Test No. | Kind No. | Manufacturing conditions: Hot working step: Heating temperature (° C.) | Forging finishing temperature (° C.) | Reduction of area (%) | Number of times of reheating | First average cooling rate (° C./sec) | First cooling stop temperature (° C.) | Retention time at 700° C. to 770° C. (h) | Cooling rate up to 200° C. or lower (° C./sec) | Cold working step: Temperature (° C.) | Reduction of area (%) |
|---|---|---|---|---|---|---|---|---|---|---|---|
| 42 | A | — | — | — | 0 | 15 | 730 | — | 1 | — | — |
| 43 | A | — | 1100 | 64 | 0 | 15 | 730 | 0.5 | 15 | — | — |
| 44 | A | 1200 | 1050 | 64 | 0 | — | — | — | 1 | 100 | 10 |
| 45 | A | — | 1000 | 64 | 0 | 12 | 730 | — | 15 | — | — |
| 46 | A | — | 1000 | 64 | 0 | 15 | 730 | — | 1 | — | — |
| 47 | A | — | 1000 | 64 | 0 | 1 | 730 | — | 1 | — | — |
| 48 | A | — | 1000 | 64 | 0 | 15 | 730 | 0.4 | 15 | — | — |
| 49 | A | — | 1000 | 64 | 0 | 15 | 730 | 25.0 | 15 | — | — |
| 50 | A | 1050 | 1000 | 64 | 1 | 15 | 730 | 25.0 | 15 | — | — |
| 51 | N | 1050 | 1000 | 51 | 1 | — | — | — | 1 | 250 | 20 |

* means outside the range of the present invention.
** means outside the preferable range of the present invention.
— means that the corresponding step is not performed.

TABLE 2-6

| Test No. | Kind No. | Microstructure after hot working: Structure morphology of α phase | Average minor axis length of β phase (μm) | Microstructure after cold working (after hot working in case where cold working is not performed): Area ratio of β phase (%) | Average minor axis length of β phase (μm) | Area ratio of β phase having KAM value of 1° or more (%) | Characteristic evaluation: VL1000 (rpm) | Hardness ($HV_{0.5}$) | |
|---|---|---|---|---|---|---|---|---|---|
| 42 | A | Acicular | 1.5 | 6 | 1.5 | 2** | 9500 | 310 | Present |
| 43 | A | Acicular | 1.9 | 18 | 1.9 | 2** | 9500 | 305 | Invention |
| 44 | A | Acicular | 2.4 | 9 | 1.7 | 45 | 10000 | 301 | Example |
| 45 | A | Acicular | 2.5 | 21* | 2.5* | 0** | 7000 | 295 | Comparative |
| 46 | A | Acicular | 2.9 | 9 | 2.9* | 0** | 6500 | 295 | Example |
| 47 | A | Acicular | 2.7 | 9 | 2.7* | 0** | 6500 | 300 | |
| 48 | A | Acicular | 2.6 | 21* | 2.6* | 1** | 7000 | 305 | |
| 49 | A | Acicular | 2.7 | 9 | 2.7* | 1** | 7500 | 305 | |
| 50 | A | Acicular | 2.7 | 9 | 2.7* | 1** | 7500 | 305 | |
| 51 | N | Acicular | 2.9 | 8 | 2.2* | 35** | 8500 | 288 | |

*means outside the range of the present invention.
**means outside the preferable range of the present invention.
— means that the corresponding step is not performed.

Test Nos. 1 to 22 and Nos. 42 to 44 satisfied the regulations of the present disclosure and showed good machinability. In particular, in Nos. 3 to 22, the area ratio of the β phase having a KAM value of 1° or more was large, and the machinability was better.

On the other hand, since Test Nos. 23 to 41 and Nos. 45 to 51 did not satisfy one or more of the regulations of the present disclosure, the machinability was poor.

Nos. 23 and 24 are examples using materials in the related art having a small Fe content and a large V content, and the machinability was insufficient.

Each of Nos. 37 to 41 is an example in which the Fe content, the Si content, the Ni content, the Cr content, and the Mn content were large respectively, and the area ratio of the β phase and the average minor axis length of the β phase were outside the range of the present disclosure. As a result, the machinability was insufficient.

In No. 25, the number of times of reheating during hot working was large, and the average minor axis length of the β phase was large. As a result, the machinability was insufficient.

In No. 26, the cooling rate after hot working was fast, the area ratio of the β phase was excessive, and the average minor axis length of the β phase was large. As a result, the machinability was insufficient.

In No. 27, the reduction of area in the pretreatment step was small, and the average minor axis length of the β phase was large. As a result, the machinability was insufficient.

In Nos. 28 and 46, the heating and holding temperatures in the pretreatment step were high, and the average minor axis length of the β phase was large. As a result, the machinability was insufficient.

In Nos. 29 and 47, the retention time in the pretreatment step was long, and the average minor axis length of the β phase was large. As a result, the machinability was insufficient.

In No. 30, the cooling rate in the pretreatment step was slow, and the average minor axis length of the β phase was large. As a result, the machinability was insufficient.

In No. 31, the cooling stop temperature in the pretreatment step was high, and the average minor axis length of the β phase was large. As a result, the machinability was insufficient.

In Nos. 32, 33, and 51, the working temperature in the cold working step was high (working was not cold working), and the average minor axis length of the β phase was large. As a result, the machinability was insufficient.

In Nos. 34 to 36, the reduction of area in the cold working step was small, and the average minor axis length of the β phase was large. As a result, the machinability was insufficient.

In No. 45, the reduction of area in the pretreatment step was small, the cooling rate in the hot working step was fast, and the area ratio of the β phase was large. As a result, the machinability was insufficient.

In No. 48, holding was insufficiently performed in a state at 700° C. to 770° C., and the subsequent cooling rate was fast. In No. 48, the area ratio of the β phase was large, and the average minor axis length of the β phase was large. As a result, the machinability was insufficient.

In Nos. 49 and 50, holding was excessively performed in a state at 700° C. to 770° C. In Nos. 49 and 50, the average minor axis length of the β phase was large. As a result, the machinability was insufficient.

INDUSTRIAL APPLICABILITY

According to the present disclosure, it is possible to obtain a bar consisting a free-cutting titanium alloy having excellent machinability. The bar of the present disclosure contributes to an improvement in productivity in a case where the bar is machined and used for components of aircrafts and transporters such as vehicles.

The invention claimed is:

1. A bar comprising a titanium alloy containing an α phase and a β phase, wherein the titanium alloy contains, as a chemical composition, by mass %:

Al: 4.5% to 6.4%;
Fe: 0.5% to 2.1%;
C: 0.01% or less;
N: 0.05% or less;
O: 0.25% or less;
V: 0.10% or less;
Si: 0% to 0.40%;
Ni: 0% to 0.15%;
Cr: 0% to 0.25%;
Mn: 0% to 0.25%; and
a remainder: Ti and impurities, an area ratio of the β phase in a metallographic structure of the titanium alloy is 1 to 20%, an average minor axis length of grains of the β phase is 2.0 μm or less, and a diameter of a cross section exceeds 2.5 mm and 1500 mm or less, and a ration of a β phase including a kernel average misorientation (KAM) value of 1° or more to the β phase is 40% or more by area ratio.

2. The bar according to claim 1, wherein the chemical composition contains, by mass %, one or more selected from the group comprising:

Si: 0.15% to 0.40%;
Ni: 0.05% to 0.15%;
Cr: 0.10% to 0.25%; and
Mn: 0.10% to 0.25%.

* * * * *